United States Patent [19]

Coifman

[11] Patent Number: 4,669,620

[45] Date of Patent: Jun. 2, 1987

[54] TAMPER-EVIDENT, CHILD-RESISTANT CLOSURE AND METHOD

[76] Inventor: Daniel Coifman, Lucchetti 1352, Condado, P.R. 00907

[21] Appl. No.: 863,780

[22] Filed: May 16, 1986

[51] Int. Cl.[4] ..... B65D 55/02

[52] U.S. Cl. ..... 215/220; 215/251

[58] Field of Search ..... 215/201, 203, 219, 220, 215/251, 253

[56] References Cited

U.S. PATENT DOCUMENTS

| | | | |
|---|---|---|---|
| 3,638,819 | 2/1972 | Roy . | |
| 3,733,001 | 5/1973 | Gach . | |
| 3,795,337 | 3/1974 | Nozawa et al. . | |
| 3,795,338 | 5/1974 | Swartzbaugh et al. . | |
| 3,809,272 | 5/1974 | Maki . | |
| 3,827,592 | 8/1974 | Deussen . | |
| 3,837,518 | 9/1974 | Gach . | |
| 3,918,602 | 11/1975 | McIntosh | 215/219 |
| 3,926,328 | 12/1975 | Cistone | 215/220 |
| 3,944,102 | 3/1976 | Grau | 215/251 |
| 3,950,917 | 4/1976 | Choksi et al. | 53/3 |
| 4,011,960 | 3/1977 | Mauvernay et al. | 215/220 |
| 4,371,088 | 2/1983 | Gach | 215/220 |
| 4,446,979 | 5/1984 | Gach et al. | 215/220 |
| 4,474,301 | 10/1984 | Davis | 215/220 |
| 4,527,701 | 7/1985 | Schaubeck | 215/220 |
| 4,535,905 | 8/1985 | Sandhaus | 215/218 |

*Primary Examiner*—George T. Hall

*Attorney, Agent, or Firm*—Hale and Dorr

[57] ABSTRACT

A tamper-evident, child-resistant closure apparatus and method for containers has a three position inner and outer cap assembly. The first position provides a shipment position in which, if the cap is tampered with, a visible indication alerts the user that tapering has occurred. The visible indication is a portion of the inner cap assembly which displaces, upon tampering, a frangibly connected disk member which is attached to the top of the outer cap member. Displacement of the frangibly connected disk member occurs in a second position of the inner and outer cap members, in which a protruding portion of the inner cap member has an interference relationship with the frangibly connected disk. To effect removal of the cap closure assembly, the inner and outer cap members must be moved axially to a third position whereby rotation of the outer cap member transfers sufficient rotational force to the inner cap member to unseat it from its sealing relationship with the container.

10 Claims, 8 Drawing Figures

TAMPER-EVIDENT, CHILD-RESISTANT CLOSURE AND METHOD

BACKGROUND OF THE INVENTION

The invention relates generally to closures for containers, and in particular to a child-resistant, tamper-evident closure for containers, for example those used in the drug industry.

It is well known that the drug industry requires a container in which the contents are safe from adulteration. Most safeguards, however, only make the container tamper resistant, and if tampered with, the container must evidence the tampered condition. The tamper-resistant or tamper-evident container ensures the end user that a container has not been adulterated and that the full measure of the contents remains in the container. The drug industry has also been careful to provide a child-resistant container to at least inhibit, and preferably prevent, young children from obtaining access to drugs and other contents of containers either displayed on a market shelf or found in the home.

Since no container is perfectly tamper-proof, as events of the day have shown, it is important to provide a container which enables the purchaser to determine whether, to the extent possible, a container has been tampered with. Accordingly, therefore, various closure apparatus have been discussed in the patent literature to disclose to the consumer whether the container being purchased has, in some manner, been altered.

Many of these tamper resistant or tamper evident closure devices are not directed to child-resistant containers, or, if directed to a child-resistant container, have complex constructions. Hence, they tend to be relatively expensive to manufacture.

It is therefore an object of the present invention to provide a reliable, simple, and inexpensive closure apparatus and method which make evident whether a child-resistant container has been tampered with. Other objects of the invention are a child-resistant, tamper-evident closure apparatus and method which are simple for an adult to use while difficult for a child to use, and which provide evidence of tampering even if the cap itself has not been removed from the container.

SUMMARY OF THE INVENTION

The invention relates to a tamper-evident, child-resistant closure apparatus and method for containers for providing a safe vehicle for dispensing over-the-counter and prescription medicines. The apparatus features an inner cap having a skirt member and a top member, the skirt member having an internal thread for engaging a mating thread of the container for securing the inner cap to the container. An outer cap also has a skirt portion and a top portion and axially receives the inner cap. The inner cap seats in the outer cap to allow coaxial rotation of the two cap members relative to each other.

One of the outer and inner cap skirt members defines first and second circumferentially directed stop regions. The other skirt member has a radially directed, circumferentially extending flange for engaging the stop regions. The outer cap member has a frangibly connected, centrally axially located removable element in its top, while the inner cap, at its top, has an outwardly protruding, centrally positioned member axially aligned with the frangible member when the inner and outer cap are in operative relation to each other. The flanges and the stop regions are cooperatively contoured for allowing insertion of the inner cap into the outer cap and for inhibiting removal of the inner cap from the outer cap after insertion.

The flange and the stop regions also provide lower and upper spaced-apart stop positions, and the inner and outer caps, at their tops, have a non-interfering relationship in the lower position and an interfering relationship at the upper position. In the upper position, wherein the interfering relationship exists, the protruding portion of the inner cap causes detachment of the frangible portion of the outer cap. The upper and lower cap members cooperatively have a biased, axial third position wherein the upper and lower cap assembly can be rotated for removal from a container sealing condition.

The method of the invention relates to a tamper-evident, child-resistant closure for a container and features the steps of frangibly connecting a central top element to the top of an outer cap member; providing a protrusion member at a centrally located top portion of an inner cap member; and inserting the inner cap member into the outer cap member to form an inner cap member and outer cap member assembly. The method further features providing a first axial stop location for the inner and outer cap members in which the protruding member and the frangibly connected element have a non-interfering relationship. In this condition, the assembly seals a container for shipment to the, for example, retailer. The invention further features providing a second axial stop position for the inner and outer cap members in which the protrusion member has an interfering relationship with, and displaces, the frangibly connected element from connection with the outer cap member. In this second stop position, the assembly cannot be rotatably removed from a sealing condition with the container. The invention still further features providing a third axial position for the upper and lower cap member assembly wherein the inner and outer cap members can be removed, as an assembly, from their sealing relationship with the container. The inner and outer cap member assembly, when removed from the container, have a relaxed state corresponding to the second axial position. Removal of the cap assembly from the container, however, requires both resilient displacement of the outer cap member relative to the inner cap member (from the second position to the third axial position), and simultaneous rotation of the outer cap member.

DESCRIPTION OF THE DRAWINGS

Other objects, features, and advantages of the invention will appear from the following description of a preferred embodiment taken together with the drawings in which.

DESCRIPTION OF A PREFERRED EMBODIMENT

Figure 1:
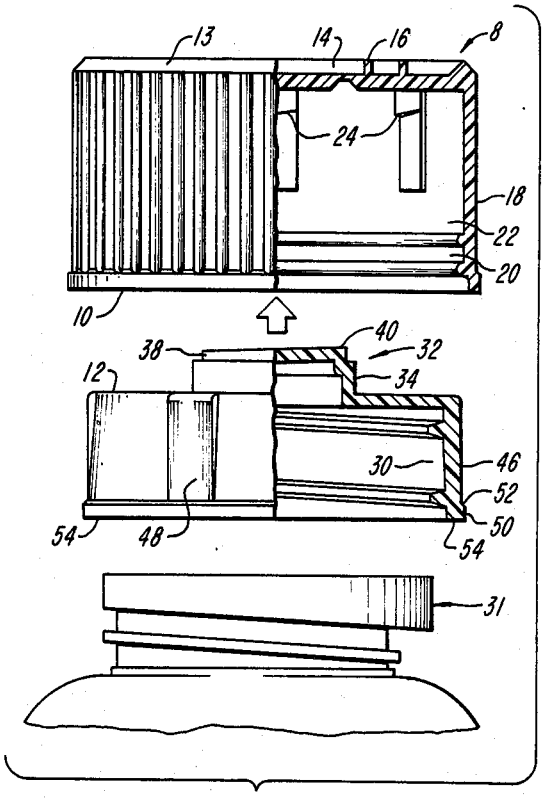
FIG. 1 is an exploded elevation view, partially cut away, of the inner and outer cap members forming the closure apparatus in accordance with the invention.

Referring to FIG. 1, a closure assembly 8 according to the invention has an outer cap member 10 and an inner cap member 12. The inner cap member 12 cooperatively and coaxially seats within the outer cap member 10 so that the two members can rotate relative to each other. As will be described in further detail hereinbelow, rotation of the closure assembly in the clockwise or closing direction, in which the cap closure assembly seals or closes a container, can occur merely by turning the outer cap member in the clockwise direction. However, opening the container, that is, removing the closure assembly, requires a combination of two movements: a downward movement of the outer cap member, in combination with counterclockwise rotation of the cap member. This simultaneous duality of motion effects removal of the cap assembly from the container. The dual action is designed to prevent small children from removing the cap closure assembly, thereby gaining access to the contents of the container.

The upper cap member has a top surface structure 13 which includes a frangibly connected, centrally located, removable disk-shaped member 14. The frangibly connected member 14 connects to the remaining top structure of the outer cap along frangible connections 16. The outer cap member further has a skirt member 18 which, in the illustrated embodiment, has two circumferentially directed recesses 20 and 22, at an interior surface thereof. The inner surface of the outer cap member 10 further has a plurality of cam-like drive elements 24 circumferentially spaced about the inner wall surface of skirt 18 as described in greater detail below.

The inner cap member, according to the illustrated embodiment of the invention, has an interior threaded portion 30 for sealingly mating with a matching threaded portion of a container 31. The inner cap member has a protruding section 32 at its outer top surface. Section 32 has a radially outwardly directed flange 34 and an upper, axially directed cylindrical section 38. Section 38 has a top surface 40 inclined at an acute angle to a plane perpendicular to a rotation axis 42 about which the cap closure assembly rotates. The inner cap member also has a skirt portion 46. The skirt portion 46 has substantially rectangularly cross-sectioned lugs 48 circumferentially spaced apart around its outer surface. The skirt member also has a lower, radially outwardly directed flange 50. Flange 50 has an inclined camming surface 52.

Figure 2:
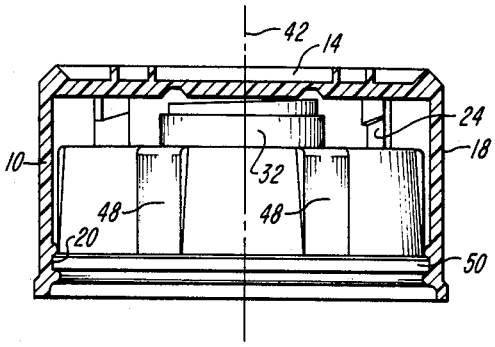
FIG. 2 is a cross-sectional view showing the inner and outer cap members in a lower, first, stop position in which the closure apparatus can be secured to a container.

Referring to FIG. 2, when the inner cap member is first inserted into the outer cap member, the flange 50 seats in the lower recess 20 of the outer cap member. In this position, the protruding section 32 has a non-interfering relationship with the outer cap member and in particular with the frangibly connected disk-shaped member 14. The lug elements 48, however, do have an interfering relationship with the cam-like elements 24 of the outer cap member. The nature of the interfering relationship in the position shown in FIG. 2, as will be described in greater detail below, allows the cap assembly to be secured by clockwise or closing rotation thereby sealing the opening of a container. The cap assembly, however, once it is securely seated on the container, cannot be removed merely by rotation of the outer cap in the counterclockwise direction. Thus, while clockwise rotation of the outer cap member effects clockwise rotation of the inner cap member through the interfering relationship of cam-like elements 24 and lugs 48, counterclockwise rotation of the outer cap member does not produce substantial rotational forces upon the inner cap member due to the inclined ramp-like surface 53 which the elements 24 present to the inner cap member lugs 48.

Figure 3:
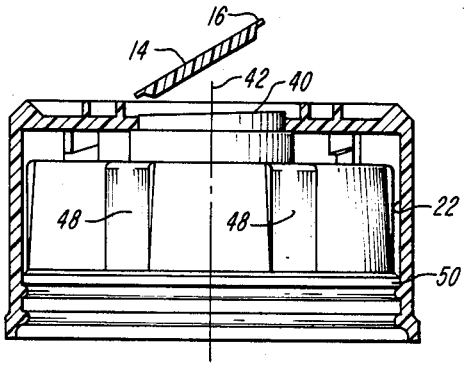
FIG. 3 is a cross-sectional view of the inner and outer cap members in an upper, second, stop position in which the tamper-evident feature, in accordance with the invention, is illustrated.
Figure 4:
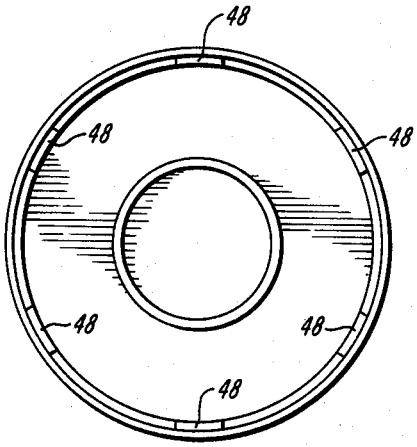
FIG. 4 is a top view of the inner cap member in accordance with the invention.

Referring now to FIG. 3, in order to effect substantial force on the inner cap member to unscrew it from the container to which it is secured, the outer cap member must be pushed in a vertically downward axial direction so that the flange 50 moves axially and seats in the second recess 22 of the outer cap member. The process of moving the inner cap member from the first stop position corresponding to recess 20 to a second stop position corresponding to a bottom section of recess 22 is aided by an inclined surface 52 of flange 50. The inner cap member is prevented from moving back to the first stop position by the inhibiting surface configuration of the flange at surface 54. Accordingly, once the inner cap member is seated within the outer cap, it is substantially and practically impossible, without physically breaking the outer cap member, to reverse axial movement of the inner cap member to return to the first stop position or to remove the inner cap from its nested relation with the outer cap.

The process of moving the outer cap member to the second stop position causes the protruding member 32 to have an interfering relationship with the frangibly connected top disk member 14 and displaces the disk from the cap member at its frangible connections in a selected sequence. As a result, the disk 14 physically separates from the outer cap member without "popping" or being forcefully propelled from the surface, and allows the top surface 40 of the protruding member 32 to be seen and distinguished. In accordance with the illustrated embodiment of the invention, the top surface of the protruding member has a different color than that of the cap. For example, the top surface of member 32 can be colored red while the remainder of the cap is colored white. It therefore becomes evident to the consumer whether someone has tampered with the cap.

Figure 6:
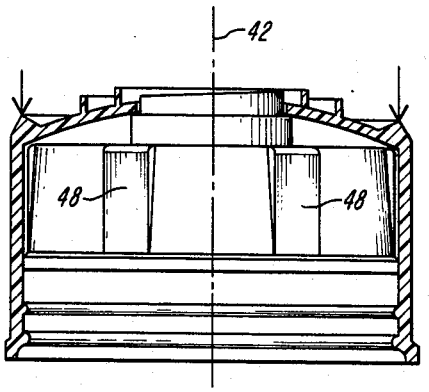
FIG. 6 is a cross-sectional view of the inner and outer cap members in a third stop position, wherein the top of the outer cap is in spring flexure for removing the closure assembly from a container.

While the inner cap member at the second stop position illustrated in FIG. 3 provides evidence of tampering, it is still not possible, with the inner cap in this position, to remove the closure from the container. In this second position, as in the first position illustrated in connection with FIG. 2, the interfering relationship of lug elements 48 and drive elements 24 only allows engagement of the cap members to seal or close the container. This is consistent with the design philosophy of preventing a small child from opening an otherwise closed bottle. To remove the cap from the bottle, referring now to FIG. 6, the outer cap portion is flexed in a downward direction toward the container so that the lug elements 48 interfere with an upper portion of drive elements 24 at a position near the top of the outer cap member. In this position, the outer cap can be turned in a counterclockwise or opening direction to effect rotation of the inner cap member, thereby unscrewing the cap from the container. The restoring force of the outer cap member, when flexed as illustrated in FIG. 6, returns the outer cap member to the position illustrated in FIG. 3 when the external forces are removed.

Figure 5:
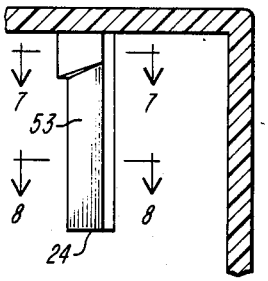
FIG. 5 is a cross-sectional elevation view of the outer cap member in accordance with the invention.
Figure 7:
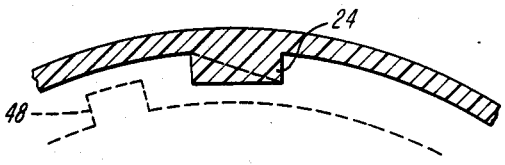
FIG. 7 is a cross-sectional view along lines 7—7 of FIG. 5.
Figure 8:
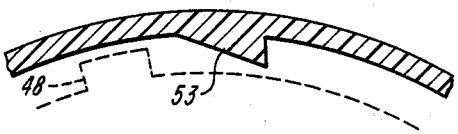
FIG. 8 is a cross-sectional view along lines 8—8 of FIG. 5.

Referring to FIG. 5, the drive elements 24 have a two component surface configuration. At a top portion of each drive element, the cross section, as illustrated in FIG. 7, is substantially rectangular or squared-off, and provides an interfering relationship with the lug elements 48 of the inner cap member irrespective of the direction of rotation. On the other hand, referring to FIG. 8, a bottom portion of the interfering drive elements 24 has an inclined surface section 53 which allows the outer cap, during counterclockwise rotation, to ramp or slip over the lug members 48 so that rotational force transmitted to the inner cap is insufficient to cause rotation of the inner cap member; and thus, the inner cap member does not unseat as a result of counterclockwise rotation of the outer cap member in the FIG. 3, second position.

Thus, in accordance with the illustrated embodiment of the invention, the inner and outer cap assembly, when in operative nested relation to each other, has three operative positions. In the first position (FIG. 2), the storage position, the cap closure seals a container but cannot be removed or unscrewed from the container. It is in this position that the package is distributed to consumer outlets and stored on display shelves. In the second position, the home storage position, the cap makes evident that it has been tampered with, but still resists a small child's attempts to remove the cap from its sealing relationship with the container. In this second position, a clear signal regarding tampering is available.

In the third or opening position, the top of the outer cap member is pushed down toward the container, causing flexing of the top of the cap and providing an interfering relationship between drive elements of the outer cap member and the lugs of the inner cap member. The outer cap member is simultaneously rotated in the counterclockwise direction (in the FIG. 6 position) to effect removal of the cap from the container. When this position is released, as noted above, the cap returns to the position of FIG. 3.

Additions, subtractions, deletions, and other modifications of the illustrated embodiment of the invention will be apparent to those practiced in the art and are within the scope of the following claims.

What is claimed is:

1. A tamper-evident, child-resistant closure for containers comprising an inner cap member having a skirt member and a top member, said skirt member having an internal thread for engaging a mating thread of said container for securing said inner cap to said container, an outer cap member having a skirt portion and a top portion for axially receiving said inner cap member for rotational movement relative thereto, said outer cap top portion having a frangibly connected, axially located, removable element, said inner cap top member having an upwardly protruding member axially aligned with said frangible member, one of said outer cap skirt portion and said inner cap skirt member having first and second circumferentially directed stop regions, the other of said inner skirt member and said outer cap skirt portion having a radially directed circumferential flange for engaging said stop regions, said flange and said stop regions being cooperatively contoured for allowing insertion of said inner cap member into said outer cap member and for inhibiting removal of said inner cap member from said outer cap member after insertion therein, said flange and said stop regions providing first lower and second upper axially spaced stop positions, and said inner and outer cap members at their top member and top portion respectively, having a non-interfering relationship in said first lower position and an interfering relationship in said second upper position wherein said protruding member causes detachment of said frangible element in said second position, and wherein said inner and outer cap members, in said second position, form an assembly which rotatably cannot be removed from a cap sealing condition with the container, and said upper and lower cup members cooperatively having a biased third axial position wherein said upper and lower cap members can be rotated for removal from said container sealing condition.

2. The tamper-evident, child-resistant closure of claim 1 wherein said outer cap skirt portion has said first and second circumferentially directed stop regions, and said inner cap skirt member has said radially directed circumferential flange for engaging said stop regions.

3. The tamper-evident, child-resistant closure of claim 2 wherein said outer cap member has, at an inner top section of its skirt portion, a plurality of two component structure drive lugs having a lower ramp-like surface section and for reducing, in the second stop position, the rotational force transmitted to the inner cap member to a level insufficient for unseating the cap assembly, and an upper squared-off surface section for transmitting, in said third position, sufficient rotational force to said inner cap member for unseating said cap assembly.

4. The tamper-evident, child-resistant closure of claim 1 wherein said protruding member has a top surface which makes an acute angle to a plane normal to the rotational axis of said cap assembly.

5. The tamper-evident, child-resistant closure of claim 1 wherein said protruding member has a top surface easily distinguishable when said frangibly connected element has been displaced from the top surface of an otherwise intact outer cap member.

6. A tamper-evident, child-resistant closure for containers comprising an inner cap member having a skirt member and a top member, said skirt member having an internal thread for engaging a mating thread of said container for securing said inner cap to said container, an outer cap member having a skirt portion and a top portion for axially receiving said inner cap member for rotational movement relative thereto, said outer cap top portion having a frangibly connected, axially located, removable element, said inner cap top member having an upwardly protruding member axially aligned with said frangible member, said outer cap skirt portion having first and second circumferentially directed stop regions, said inner cap skirt member having a radially directed circumferential flange for engaging said stop regions, said flange and said stop regions being cooperatively contoured for allowing insertion of said inner cap member into said outer cap member and for inhibiting removal of said inner cap member from said outer cap member after insertion therein, said flange and said stop regions providing first lower and second upper axially spaced stop positions, and said inner and outer cap members at their top member and top portion respectively, having a non-interfering relationship in said first lower position and an interfering relationship in said second upper position wherein said protruding member causes detachment of said frangible element in said second position, and wherein said inner and outer cap members, in said second position, form an assembly which rotatably cannot be removed from a cap sealing condition with the container, said upper and lower cup members cooperatively having a biased third axial position wherein said upper and lower cap members can be rotated for removal from said container sealing condition, said protruding member having a top surface which makes an acute angle to a plane normal to a rotation axis of said cap assembly, and which is easily distinguishable when said frangibly connected element has been displaced from the top surface of an otherwise intact outer cap member, and wherein said outer cap member has, at an inner top section of its skirt portion, a plurality of two component structure drive lugs having a lower ramp-like surface section and for reducing, in the second stop position, the rotational force transmitted to the inner cap member to a level insufficient for unseating the cap assembly, and an upper squared-off surface section for transmitting, in said third position, sufficient rotational force to said inner cap member for unseating said cap assembly.

7. A method for providing a tamper-evident, child-resistant closure for a container comprising the steps of frangibly connecting a central top element at the top of an outer cap member, providing a protrusion member at a centrally located top portion of an inner cap member, inserting the inner cap member into the outer cap member to form an inner cap member and outer cap member assembly, providing a first axial stop location for said inner and outer cap members wherein said protruding member and said frangibly connected element having a non-interfering relationship, sealing a container with said inner cap member and outer cap member assembly, providing a second axial stop location for said inner and outer cap members wherein said protrusion member has an interfering relationship with and displaces said frangibly connected element from connection with said outer cap member and wherein said assembly cannot be rotatively removed from a sealing condition with said container, providing a third axial position wherein said inner and outer cap member assembly can be removed from said container, said inner and outer cap member assembly, when removed from said container, having a relaxed state corresponding to said second axial position, whereby removal of said cap assembly from said container requires both resilient displacement of said outer cap member from said second position to said third stop position relative to the inner cap member, and simultaneous rotation of said outer cap member.

8. The method of claim 1 further comprising the step of selectively displacing said frangibly connected element at said connections so that said connections break in a selected sequence whereby said element is not forcefully propelled from its connected position.

9. The method of claim 1 further comprising the step of easily distinguishing a top surface of said protruding member from the top surface of the outer cap member when said frangibly connected element has been displaced.

10. A method for providing a tamper-evident, child-resistant closure for a container comprising the steps of frangibly connecting a central top element at the top of an outer cap member, providing a protrusion member at a centrally located top portion of an inner cap member, inserting the inner cap member into the outer cap member to form an inner cap member and outer cap member assembly, providing a first axial stop location for said inner and outer cap members wherein said protruding member and said frangibly connected element having a non-interfering relationship, sealing a container with said inner cap member and outer cap member assembly, providing a second axial stop location for said inner and outer cap members wherein said protrusion member has an interfering relationship with and selectively displaces said frangibly connected element from connection with said outer cap member so that said connections break in a selected sequence whereby said element is not forcefully propelled from its connected position, and wherein said assembly cannot be rotatively removed from a sealing condition with said container, easily distinguishing a top surface of said protruding member from the top surface of the outer cap member when said frangibly connected element has been displaced, and providing a third axial position wherein said inner and outer cap member assembly can be removed from said container, said inner and outer cap member assembly, when removed from said container, having a relaxed state corresponding to said second axial position, whereby removal of said cap assembly from said container requires both resilient displacement of said outer cap member from said second position to said third stop position relative to the inner cap member, and simultaneous rotation of said outer cap member.

* * * * *